US009234440B2

(12) United States Patent
Hashimoto et al.

(10) Patent No.: US 9,234,440 B2
(45) Date of Patent: Jan. 12, 2016

(54) STRUCTURE FOR GAS TURBINE CASING

(75) Inventors: Yukihiro Hashimoto, Tokyo (JP); Shinya Hashimoto, Tokyo (JP)

(73) Assignee: MITSUBISHI HITACHI POWER SYSTEMS, LTD., Tokyo (JP)

( * ) Notice: Subject to any disclaimer, the term of this patent is extended or adjusted under 35 U.S.C. 154(b) by 887 days.

(21) Appl. No.: 13/383,637

(22) PCT Filed: Sep. 9, 2010

(86) PCT No.: PCT/JP2010/065467

§ 371 (c)(1),
(2), (4) Date: Mar. 14, 2012

(87) PCT Pub. No.: WO2011/102014

PCT Pub. Date: Aug. 25, 2011

(65) Prior Publication Data

US 2012/0163963 A1 Jun. 28, 2012

(30) Foreign Application Priority Data

Feb. 19, 2010 (JP) ..... 2010-034218

(51) Int. Cl.
*F01D 25/24* (2006.01)

(52) U.S. Cl.
CPC ..... *F01D 25/243* (2013.01); *F05D 2240/55* (2013.01); *F05D 2260/941* (2013.01)

(58) Field of Classification Search
CPC . F01D 25/243; F01D 25/265; F05D 2260/30; F05D 2260/31; F05D 2260/941
See application file for complete search history.

(56) References Cited

FOREIGN PATENT DOCUMENTS

| | | | | |
|---|---|---|---|---|
| CN | 101189411 | A | | 5/2008 |
| JP | 59196911 | A | * | 11/1984 |
| JP | 7-8825 | Y2 | | 3/1995 |
| JP | 9-133026 | A | | 5/1997 |
| JP | 10-026006 | A | | 1/1998 |
| JP | 2002-038906 | A | | 2/2002 |
| JP | 2005-61273 | A | | 3/2005 |
| JP | 2005061273 | A | * | 3/2005 |
| JP | 2007-120462 | A | | 5/2007 |
| JP | 2011-169246 | A | | 9/2011 |

OTHER PUBLICATIONS

Machine Translation of JP2005-061273A, Mar. 25, 2015, J-PlatPat.*
Chinese Office Action dated Aug. 1, 2013, issued in corresponding China Application No. 201080034151.9, w/ English Translation. (14 pages).

(Continued)

*Primary Examiner* — Craig Kim
*Assistant Examiner* — Adam W Brown
(74) *Attorney, Agent, or Firm* — Westerman, Hattori, Daniels & Adrian, LLP

(57) ABSTRACT

A structure for a gas turbine casing, capable of preventing gas from leaking when the structure is subjected to pressure. A structure for a gas turbine casing, divided by a horizontal plane at flange sections into two halves comprising an upper-half casing (10) and a lower-half casing (11). The structure is provided with bolts (12) which are disposed in the inner surfaces of the upper-half casing (10) and the lower-half casing (11) so as to bridge therebetween, upper nuts (13) which are disposed in the inner surface of the upper-half casing (10) and attached to the bolts (12), and lower nuts (14) which are disposed in the inner surface of the lower-half casing (11) and attached to the bolts (12).

1 Claim, 5 Drawing Sheets

(56) References Cited

OTHER PUBLICATIONS

International Search Report of PCT/JP2010/065467, mailing date Dec. 21, 2010.

Written Opinion of PCT/JP2010/065467, mailing date Dec. 21, 2010.

Korean Decision for Grant of Patent dated Jun. 27, 2013, issued in corresponding Korean Patent Application No. 10-2013-7008283, w/ English translation.

* cited by examiner

——Prior Art——

——Prior Art——

STRUCTURE FOR GAS TURBINE CASING

TECHNICAL FIELD

This invention relates to a gas turbine casing structure.

BACKGROUND ART

A gas turbine casing of a gas turbine accommodating interiorly components, such as a rotor and a nozzle diaphragm, is composed of a structure, which is divided into two halves by a horizontal plane and fastened by bolts in flange structures, in order to facilitate the installation and inspection of these components, and to prevent gas leakage during operation (see, for example, Patent Document 1 to be described below).

FIG. 4 is a schematic view showing a conventional gas turbine casing structure. In FIG. 4, its cross section in the axial direction of a bolt is illustrated.

As shown in FIG. 4, the gas turbine casing structure is divided into two halves, namely, an upper-half casing 100 and a lower-half casing 101. The upper-half casing 100 and the lower-half casing 101 are composed of shell sections 100*a*, 101*a* and flange sections 100*b*, 101*b*, respectively. The bonding between the upper-half casing 100 and the lower-half casing 101 is performed by fastening each bolt 102, each upper nut 103 and each lower nut 104 together.

That is, each flange of the gas turbine casing is divided into equal halves, i.e., the flange section 100*b* of the upper-half casing 100 and the flange section 101*b* of the lower-half casing 101. The flange sections 100*b*, 101*b* are provided with many bolt holes 100*c*, 101*c*. The bolt 102 is disposed in each of the bolt holes 100*c*, 101*c*, and fastened with the upper nut 103 and the lower nut 104.

PRIOR ART DOCUMENTS

Patent Documents

Patent Document 1: JP-A-2007-120462

SUMMARY OF THE INVENTION

Problems to be Solved by the Invention

In recent years, gas turbines have become so great in capacity and output that their upsizing and high pressure run have been performed. In accordance with these trends, there have been gas leakage during operation, and increases in the pressure acting on the gas turbine casing during operation. With the conventional gas turbine casing structure shown in FIG. 4, moment has increased during application of a pressure as indicated by arrows P in FIG. 4. As indicated by short dashed lines in FIG. 4, therefore, the amounts of opening between the flange section 100*b* of the upper-half casing 100 and the flange section 101*b* of the lower-half casing 101 have increased. As a result, there has been a possibility for a gas to leak through the bolt holes 100*c*, 101*c*, as shown by arrows G in FIG. 4.

FIG. 5 is a schematic view showing the conventional gas turbine casing structure with the flange sections heightened. In FIG. 5, a cross section of the structure in the axial direction of the bolt is illustrated.

As shown in FIG. 5, the flange section 100*b* of the upper-half casing 100 and the flange section 101*b* of the lower-half casing 101 are increased in height, and the upper-half casing 100 and the lower-half casing 101 are fastened together by the bolts 102, the upper nuts 103 and the lower nuts 104 at the middle of the wall thickness of the shell sections 100*a*, 101*a*, in order to prevent gas leakage. This procedure is more advantageous, because it can diminish the moment during application of pressure as indicated by the arrows P in FIG. 5.

When the heights of the flange section 100*b* of the upper-half casing 100 and the flange section 101*b* of the lower-half casing 101 are increased, however, the heat capacity of the flange sections 100*b*, 101*b* grows. During a process in which the temperature at start rises, the difference in temperature between the flange sections 100*b*, 101*b* and the shell sections 100*a*, 101*a* increases. Consequently, thermal stress occurs at the boundaries between the flange sections 100*b*, 101*b* and the shell sections 101*a*, 102*a* indicated by arrows S in FIG. 5. In this case, decline in strength due to fatigue is feared.

It is an object of the present invention, therefore, to provide a gas turbine casing structure which can prevent gas leakage when pressure is exerted on the structure.

Means for Solving the Problems

A gas turbine casing structure according to a first aspect of the present invention for solving the above-mentioned problems is a gas turbine casing structure divided by a horizontal plane at flange sections into two halves composed of an upper-half casing and a lower-half casing, the gas turbine casing structure including bolts which are disposed in inner surfaces of the upper-half casing and the lower-half casing so as to bridge therebetween, upper nuts which are disposed in the inner surface of the upper-half casing and attached to the bolts, and lower nuts which are disposed in the inner surface of the lower-half casing and attached to the bolts.

A gas turbine casing structure according to a second aspect of the present invention for solving the above-mentioned problems is a gas turbine casing structure divided by a horizontal plane at flange sections into two halves composed of an upper-half casing and a lower-half casing, the gas turbine casing structure including:

separate members each disposed between a groove formed in each of the flange sections of the upper-half casing and a groove formed in each of the flange sections of the lower-half casing, the separate members being capable of acting differently from the upper-half casing and the lower-half casing, and sealing members installed in concave portions formed in an upper surface of the separate member, a lower surface of the separate member, an upper side surface of the separate member beside an inner surface of the upper-half casing, and a lower side surface of the separate member beside an inner surface of the lower-half casing.

A gas turbine casing structure according to a third aspect of the present invention for solving the above-mentioned problems is the gas turbine casing structure according to the second aspect of the present invention, wherein the sealing members are disposed at positions at which the sealing members contact the upper-half casing and the lower-half casing and can seal them when pressure is exerted on the gas turbine casing structure.

Effects of the Invention

According to the present invention, there can be provided a gas turbine casing structure which can prevent gas leakage during application of pressure.

MODE FOR CARRYING OUT THE INVENTION

The gas turbine casing structure according to the present invention will be described below by reference to drawings.

Embodiment 1

Hereinbelow, a first embodiment of the gas turbine casing structure according to the present invention will be described.

Figure 1A:
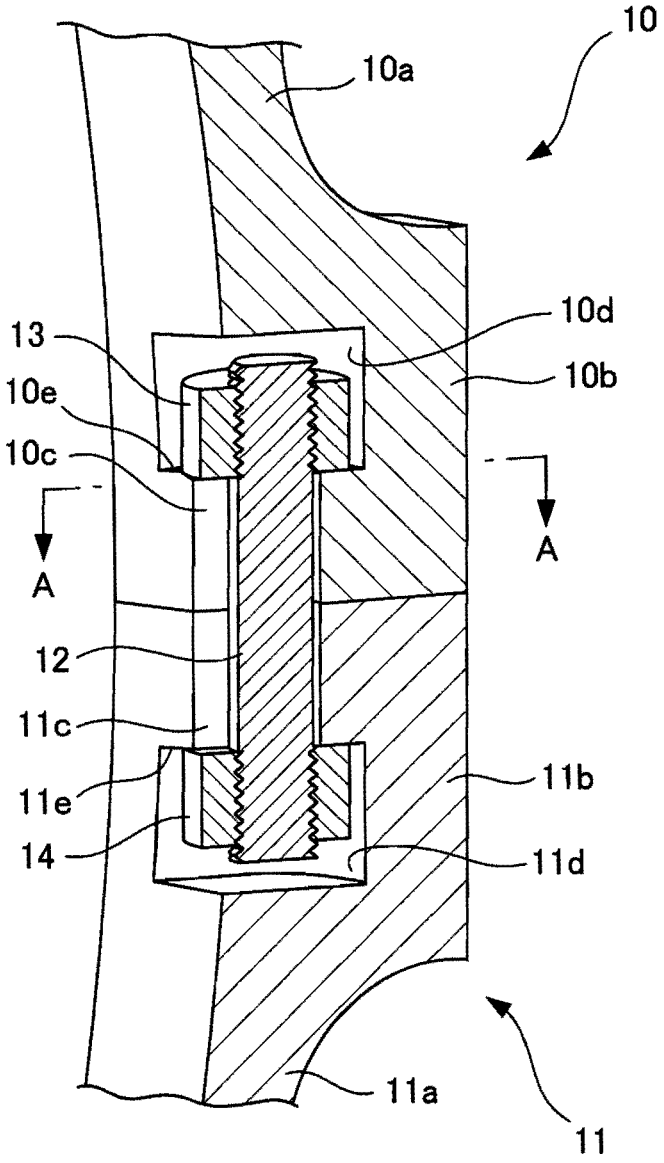
FIGS. 1(*a*), 1(*b*) are schematic views showing cross sections of a gas turbine casing structure according to a first embodiment.
Figure 1B:
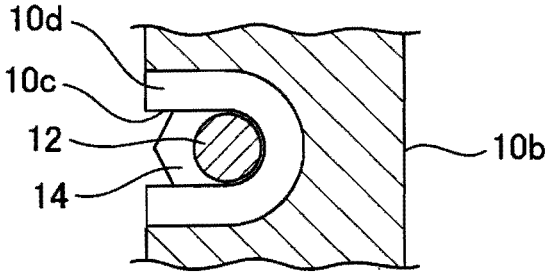

FIGS. 1(*a*) and 1(*b*) are schematic views showing cross sections of a gas turbine casing structure according to the present embodiment. FIG. 1(*a*) is a schematic view showing a cross section in the axial direction of a bolt. FIG. 1(*b*) is a schematic view showing a cross section taken along the arrowed line A-A in FIG. 1(*a*).

As shown in FIG. 1(*a*), the gas turbine casing structure according to the present embodiment is divided into two halves, i.e., an upper-half casing 10 and a lower-half casing 11, by a horizontal plane at flange sections. The upper-half casing 10 and the lower-half casing 11 are composed of shell sections 10*a*, 11*a* and flange sections 10*b*, 11*b*.

In the gas turbine casing structure according to the present embodiment, bolt installation grooves 10*c*, 11*c* for installing bolts 12 are formed to span the inner surface of the flange section 10*b* of the upper-half casing 10 and the inner surface of the flange section 11*b* of the lower-half casing 11.

Above each of the bolt installation grooves 10*c* in the inner surface of the flange section 10*b* of the upper-half casing 10, a concave portion 10*d* is formed for installing an upper nut 13. Above each of the bolt installation grooves 11*c* in the inner surface of the flange section 11*b* of the lower-half casing 11, a concave portion 11*d* is formed for installing a lower nut 14.

As shown in FIGS. 1(*a*) and 1(*b*), a lower wall surface of the concave portion 10*d* for installing the upper nut 13 of the upper-half casing 10 constitutes a bearing surface 10*e* for the upper nut 13, while an upper wall surface of the concave portion 11*d* for installing the lower nut 14 of the lower-half casing 11 constitutes a bearing surface 11*e* for the lower nut 14.

The bolt 12 and the upper nut 13 are fastened together in the inner surface of the upper-half casing 10, and the bolt 12 and the lower nut 14 are fastened together in the inner surface of the lower-half casing 11, whereby the upper-half casing 10 and the lower-half casing 11 are fastened together.

In the gas turbine casing structure according to the present embodiment, deficient parts are produced by forming the concave portion 10*d* of the upper-half casing 10 and the concave portion 11*d* of the lower-half casing 11. In order to ensure the strength of the deficient parts, minimum required reinforcement is carried out in the height direction and the thickness direction of the flange section 10*b* of the upper-half casing 10 and the flange section 11*b* of the lower-half casing 11.

With the gas turbine casing structure according to the present embodiment, therefore, the moment during exertion of pressure can be minimized, in comparison with the placement of the bolt on the external side of the flange section as in the conventional gas turbine casing structure, by disposing the bolt 12 in the inner surfaces of the upper-half casing 10 and the lower-half casing 11. By this procedure, the amount of opening of the flange section 10*b* of the upper-half casing 10 relative to the flange section 11*b* of the lower-half casing 11 can be diminished.

Figure 4:
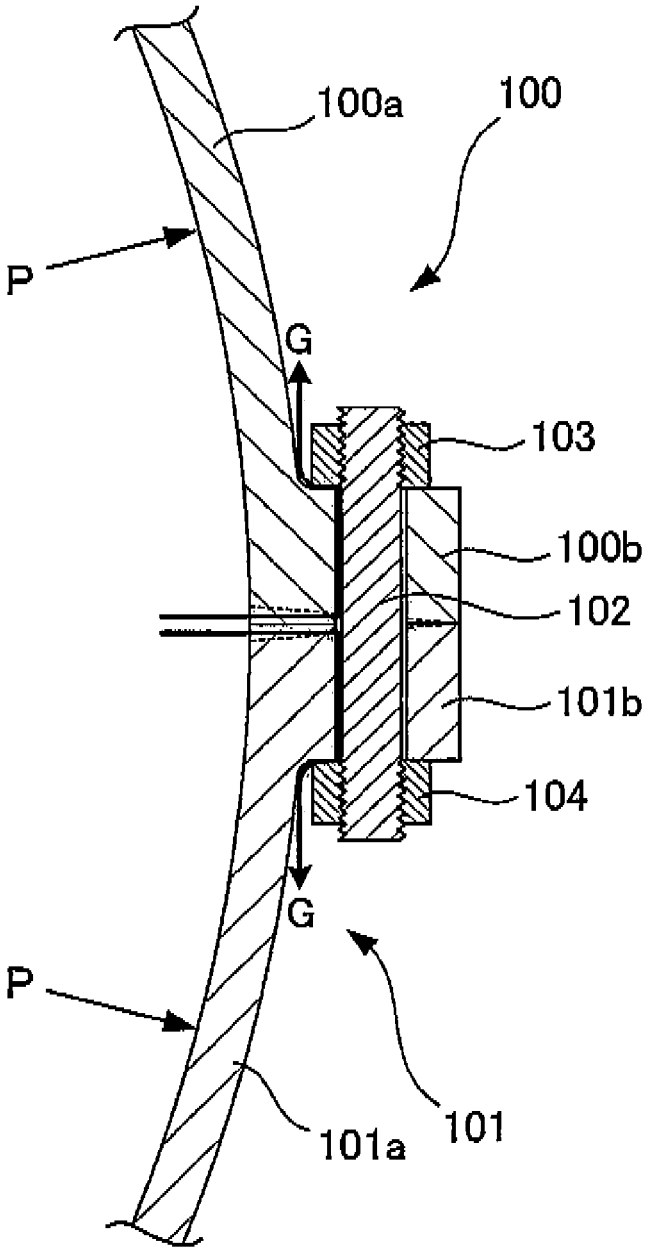
FIG. 4 is a schematic view showing a cross section of a conventional gas turbine casing structure.
Figure 5:
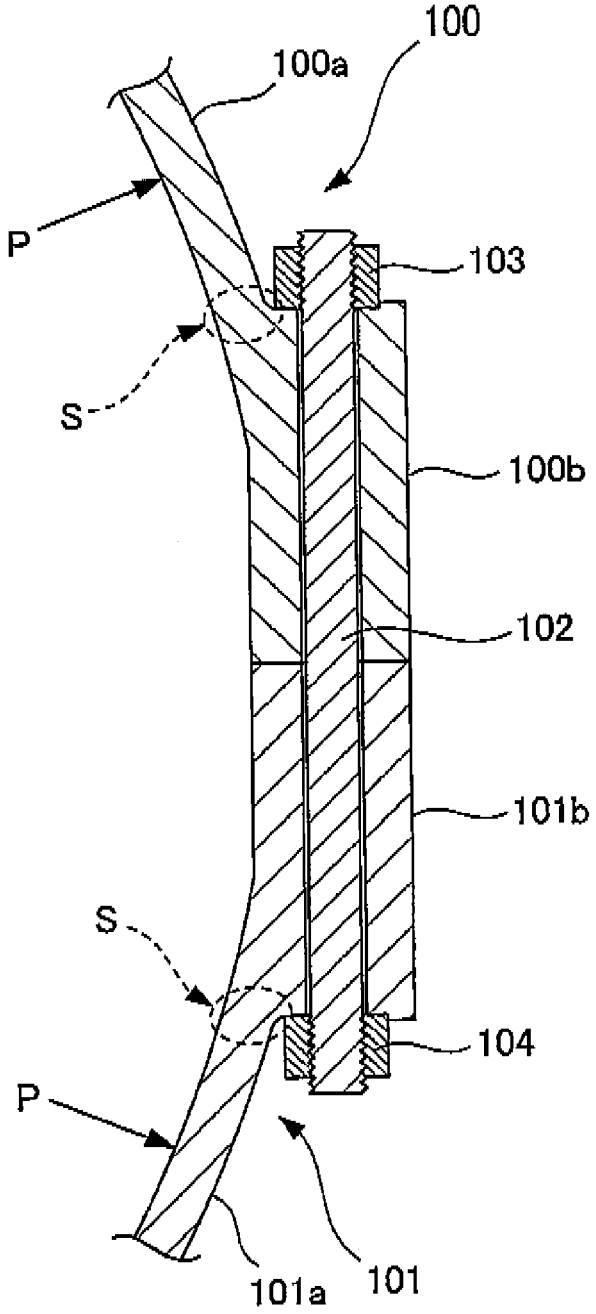
FIG. 5 is a schematic view showing a cross section of the conventional gas turbine casing structure with flange sections being heightened.

By so disposing the bolt 12 in the inner surfaces of the upper-half casing 10 and the lower-half casing 11, moreover, gas leakage through the bolt holes 100*c*, 101*c* can be eliminated, because it is not that the bolt holes 100*c*, 101*c* (see FIG. 4) penetrate the flanges 10*b*, 11*b* as in the conventional gas turbine casing structure.

By thus disposing the bolt 12 in the inner surfaces of the upper-half casing 10 and the lower-half casing 11, moreover, gas can be sealed in reliably, because contact pressure acting between the outside of the flange section 10*b* of the upper-half casing 10 and the outside of the flange section 11*b* of the lower-half casing 11 can be raised by the moment.

Embodiment 2

Hereinbelow, a second embodiment of the gas turbine casing structure according to the present invention will be described.

Figure 2:
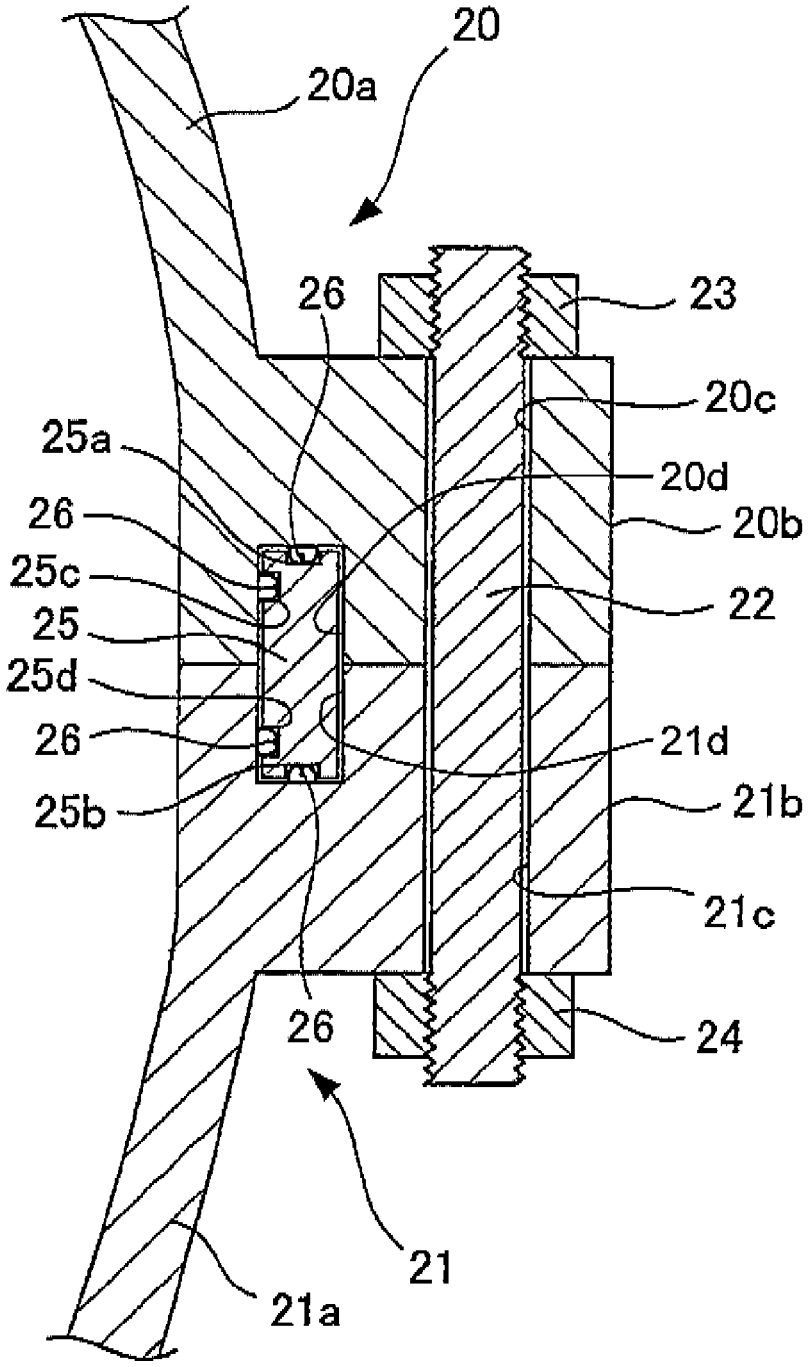
FIG. 2 is a schematic view showing a cross section of a gas turbine casing structure according to a second embodiment.

FIG. 2 is a schematic view showing a cross section of the gas turbine casing structure according to the present embodiment. FIG. 2 is the schematic view showing the cross section in the axial direction of a bolt.

As shown in FIG. 2, the gas turbine casing structure according to the present embodiment is composed of an upper-half casing 20 and a lower-half casing 21. The upper-half casing 20 and the lower-half casing 21 are composed of shell sections 20*a*, 21*a* and flange sections 20*b*, 21*b*.

Bolt holes 20*c* are formed in the flange section 20*b* of the upper-half casing 20, and bolt holes 21*c* are formed in the flange section 21*b* of the lower-half casing 21. Binding between the upper-half casing 20 and the lower-half casing 21 is performed by fastening together bolts 22 installed in the bolt holes 20*c*, 21*c*, upper nuts 23 and lower nuts 24.

In the gas turbine casing structure according to the present embodiment, grooves 20*d* are formed within the flange sections 20*b* of the upper-half casing 20, grooves 21*d* are formed within the flange sections 21*b* of the lower-half casing 21, and separate members 25 which can act independently of the flange sections 20*b*, 21*b* are inserted into the grooves.

In each separate member 25, a concave portion 25*a* is formed in its upper surface, a concave portion 25*b* is formed in its lower surface, a concave portion 25*c* is formed in its upper side surface beside the inner surface of the upper-half casing 20, and a concave portion 25*d* is formed in its lower side surface beside the inner surface of the lower-half casing 21. Sealing members 26 are installed in the concave portions 25*a*, 25*b*, 25*c*, 25*d* of the separate member 25. In the present embodiment, metallic E-seals are used as the sealing members 26.

Figure 3:
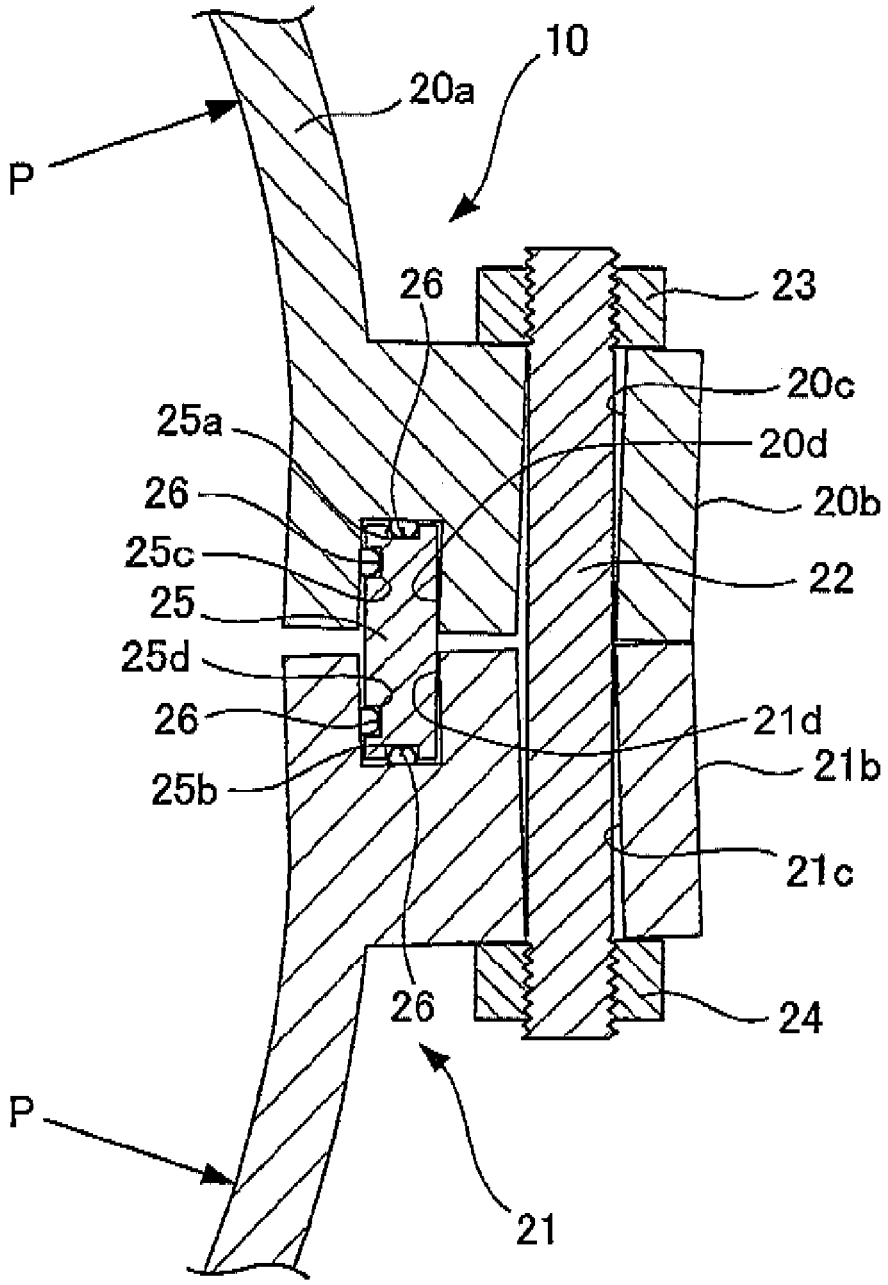
FIG. 3 is a schematic view showing the cross section of the gas turbine casing structure according to the second embodiment when pressure is exerted on the gas turbine casing structure.

FIG. 3 is a schematic view showing the cross section of the gas turbine casing structure according to the present embodiment when pressure is exerted on the gas turbine casing structure. FIG. 3 is also a schematic view showing the cross section in the axial direction of the bolt. In FIG. 3, it is to be noted that the gas turbine casing structure is expressed exaggeratedly, in comparison with its actual state, for understanding.

In the gas turbine casing structure according to the present embodiment, as shown in FIG. 3, the separate member 25 inserted between the groove 20*d* and the groove 21*d* makes a motion different from those of the flange sections 20*b*, 21*b* when pressure is exerted as indicated by arrows P in FIG. 3. As a result, the sealing members 26 contact the upper-half casing 20 and the lower-half casing 21, making sealing possible. That is, the sealing members 26 are arranged in advance at positions where they contact the upper-half casing 20 and the lower-half casing 21 during application of pressure, making sealing possible.

With the gas turbine casing structure according to the present embodiment, therefore, gas can be sealed in reliably by installing the sealing members 26 in the concave portions of the separate member 25 inserted between the groove 20*d* and the groove 21*d*.

With the gas turbine casing structure according to the present invention, as described above, there can be provided a gas turbine casing structure which can prevent gas leakage during application of pressure.

INDUSTRIAL APPLICABILITY

The present invention can be utilized, for example, for the gas turbine casing structure of a gas turbine.

EXPLANATIONS OF LETTERS OR NUMERALS

10 Upper-half casing
10*a* Shell section
10*b* Flange section
10*c* Bolt installation groove
10*d* Concave portion
10*e* Bearing surface
11 Lower-half casing
11*a* Shell section
11*b* Flange section
11*c* Bolt installation groove
11*d* Concave portion
11*e* Bearing surface
12 Bolt
13 Upper nut
14 Lower nut
20 Upper-half casing
20*a* Shell section
20*b* Flange section
20*c* Bolt hole
20*d* Groove
21 Lower-half casing
21*a* Shell section
21*b* Flange section
21*c* Bolt hole
21*d* Groove
22 Bolt
23 Upper nut
24 Lower nut
25 Separate member
25*a*, 25*b*, 25*c*, 25*d* Concave portion
26 Sealing member

The invention claimed is:

1. A gas turbine casing structure comprising:

an upper-half casing;

a lower-half casing;

bolts disposed in bolt installation grooves formed in an inner surface of the upper-half casing and in an inner surface of the lower-half casing, the bolts bridging between the upper-half casing and the lower-half casing;

upper nuts disposed and attached to the bolts in concave portions formed above the respective bolt installation grooves in the inner surface of the upper-half casing; and lower nuts disposed and attached to the bolts in concave portions formed below the respective bolt installation grooves in the inner surface of the lower-half casing, wherein a total dimension of the bolt installation groove and the concave portion of the upper-half casing and of the bolt installation groove and the concave portion of the lower-half casing, in a thickness direction of a flange section of the upper-half casing and a flange section of the lower-half casing, is smaller than a total dimension of the flange sections, in the thickness direction of the flange sections.

* * * * *